United States Patent [19]

Milly et al.

[11] Patent Number: 4,845,801

[45] Date of Patent: Jul. 11, 1989

[54] VEHICLE FOR CLEANING BY LIQUID SPRAYING AND SUCTION

[75] Inventors: Gérard Milly, Reims; Claude D. Le, Sevran, both of France

[73] Assignee: Commissariat A L'Energie Atomique, Paris, France

[21] Appl. No.: 151,972

[22] Filed: Feb. 3, 1988

[30] Foreign Application Priority Data

Feb. 5, 1987 [FR] France ..... 87 01413

[51] Int. Cl.[4] ..... E01H 1/08

[52] U.S. Cl. ..... 15/321; 15/340.1

[58] Field of Search ..... 15/320, 321, 322, 340.1

[56] References Cited

U.S. PATENT DOCUMENTS

| | | | |
|---|---|---|---|
| 2,731,659 | 1/1956 | Coplen | 15/320 |
| 3,151,348 | 10/1964 | Maasberg | 15/320 |
| 3,447,188 | 6/1969 | Maasberg | 15/320 |
| 3,959,010 | 5/1976 | Thompson | 134/21 |
| 4,168,562 | 9/1979 | Maasberg | 15/322 X |
| 4,369,544 | 1/1983 | Parisi | 15/320 |

FOREIGN PATENT DOCUMENTS

| | | |
|---|---|---|
| 2617635 | 9/1977 | Fed. Rep. of Germany . |
| 3230520 | 2/1984 | Fed. Rep. of Germany . |
| 3316953 | 11/1984 | Fed. Rep. of Germany . |

*Primary Examiner*—Chris K. Moore

*Attorney, Agent, or Firm*—Michael N. Meller

[57] ABSTRACT

A vehicle for cleaning surfaces is provided with a first tank for storing cleaning liquid; a device for spraying liquid at a first pressure and a first flow rate onto the surface to be cleaned; a device for sucking the sprayed liquid towards a second tank; and a device for moistening the surface to be cleaned with liquid at a second pressure and a second flow rate. The second pressure is lower than the first pressure and the second flow rate is lower than the first flow rate. The spraying and sucking devices are located at the rear of the vehicle and the moistening device is located at the front of the vehicle.

5 Claims, 3 Drawing Sheets

VEHICLE FOR CLEANING BY LIQUID SPRAYING AND SUCTION

Figure 1:
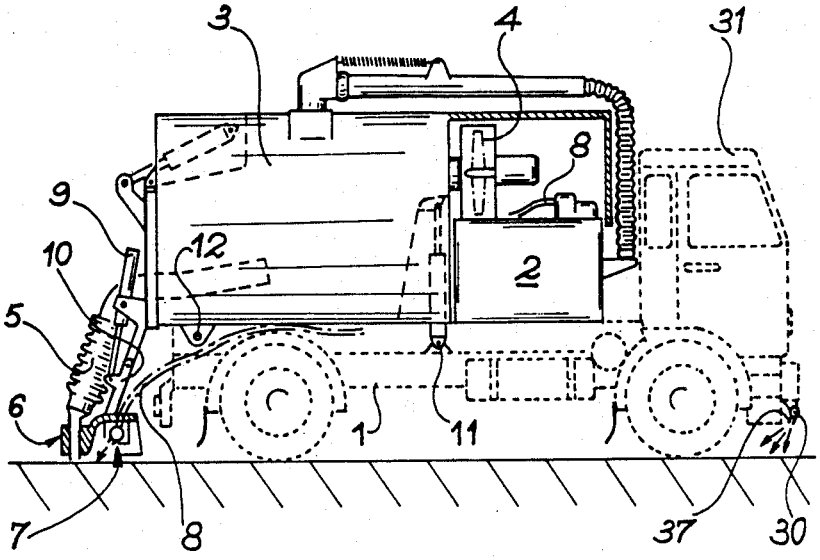

The present invention relates to a vehicle for cleaning purposes involving the spraying and suction of liquid with respect to surfaces and particularly road surfaces.

Road vehicles used for spraying or watering are well known, particularly in large cities. These are generally in the form of vans or motor cycles equipped with a water tank, to the rear of which is installed a sidewalk or road spraying means. The cleaning water then flows into the drains.

However, such cleaning vehicles are not suitable for the cleaning of large surfaces which have no means for draining off the liquid, which then stagnates. In particular, this cleaning principle is unsuitable in the case of pollution by chemical or radioactive particles, which must be collected after having been removed from the polluted surfaces.

U.S. Pat. No. 3,959,010 in the name of Thompson supplies a vehicle suitable for dealing with such pollution. It comprises means for spraying water onto the surface of the ground and sucking up the emulsion of water and polluting dust or particles detached from the ground by the impact of the water jets. This patent more particularly deals with the aerodynamic conditions to be achieved for effecting a good suction.

Thompson has positioned water spraying and suction devices side by side, so as to ensure that there is no flow and dispersion of the water after it has reached the ground and for cleaning the suction device by spraying on part of the water. However, it proved necessary to place these devices in front of the vehicle, because the wheels and chassis of the vehicle caused air disturbances and whirling, which would disperse some of the polluting particles in a sideways direction. Therefore the dispersed particles could not be collected.

Because the effluent and clean liquid tanks, together with the hydraulic equipment must be located to the rear of the vehicle, in order that the vehicle can be driven with an adequate field of vision, it is necessary to significantly lengthen the pipes joining the tanks to the suction and spraying equipment while making them pass over the entire length of the top of the vehicle. This leads to much greater overall dimensions and to increased pressure losses, i.e. a higher energy consumption.

The present invention solves this problem by combining on a single vehicle, the cleaning liquid spraying means and the sprayed liquid suction means, which will then be charged with polluting particles, said means being located to the rear of the vehicle, with a device located to the front of the vehicle making it possible to maintain the polluting particles in place while waiting for the suction thereof.

More specifically, the present invention relates to a surface cleaning vehicle having a cleaning liquid tank, a device for spraying liquid onto the surface to be cleaned and a device for sucking the sprayed liquid into a second tank, characterized in that the spraying and suction devices are located to the rear of the vehicle and in that the vehicle also has a device for moistening the surface at the front of the vehicle.

The liquid spraying and suction devices are positioned along two lines oriented transversely with respect to the vehicle. The efficiency of the system is improved if the spraying and suction devices are isolated from the external medium by fairings terminated by liquid-tight bands dragging on the surface to be cleaned.

A greater cleaning efficiency is obtained if the spraying and suction devices are separated by a liquid-tight band, whose lower edge is at a limited distance from the surface.

A preferred embodiment of the invention is described in non-limitative manner hereinafter with reference to the drawings, wherein:

FIG. 1 is a general view of the vehicle.

Figure 2:
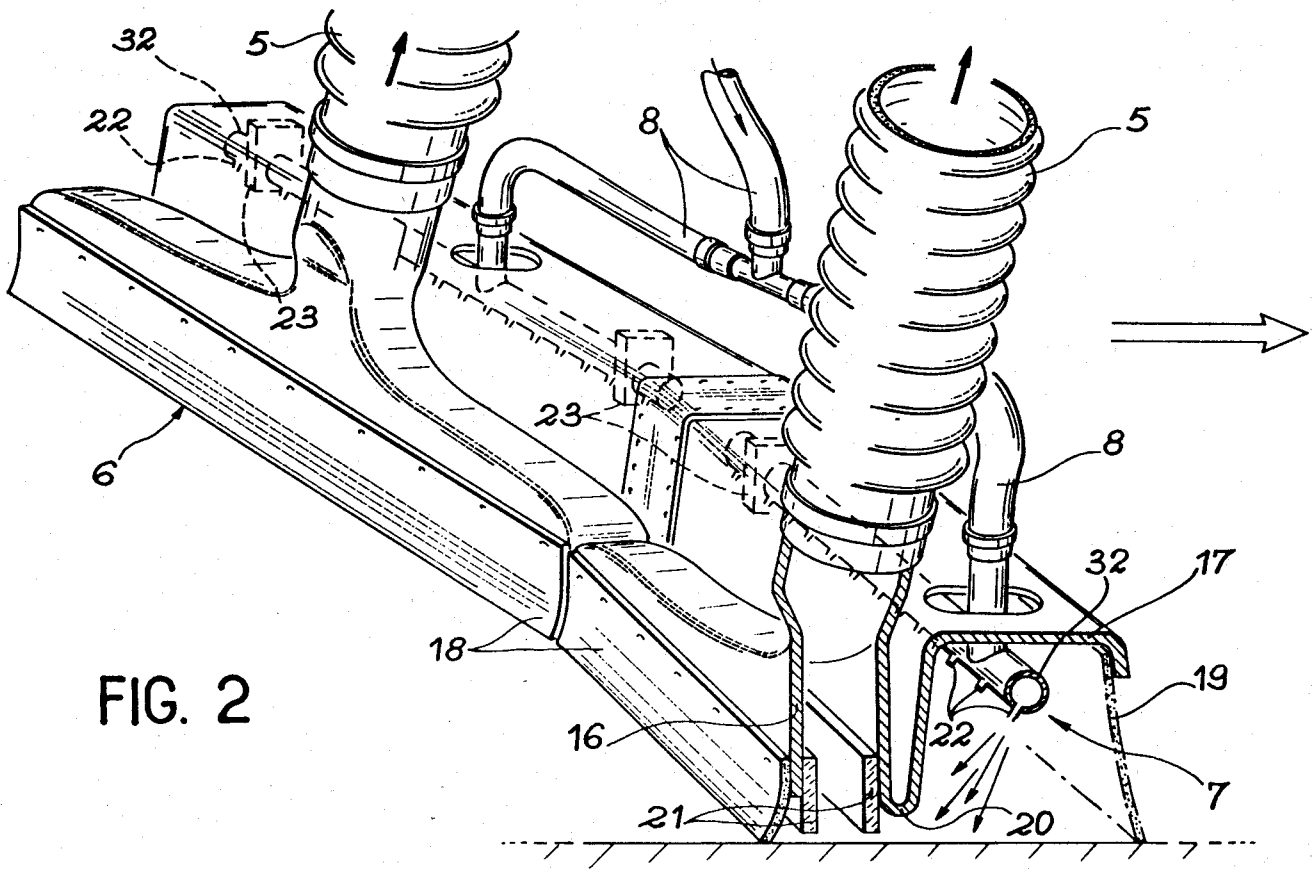
Figure 3:
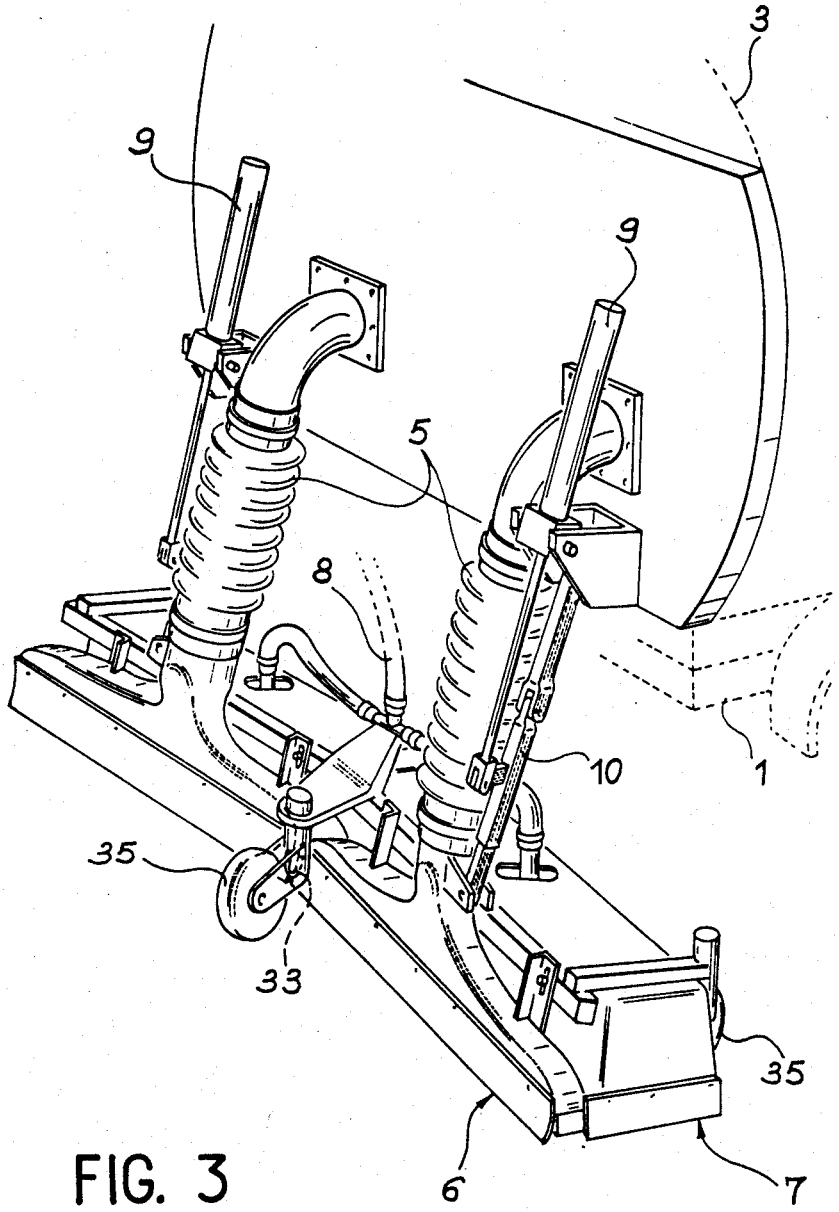

FIGS. 2 and 3 respectively show the liquid spraying and suction devices.

Figure 4:
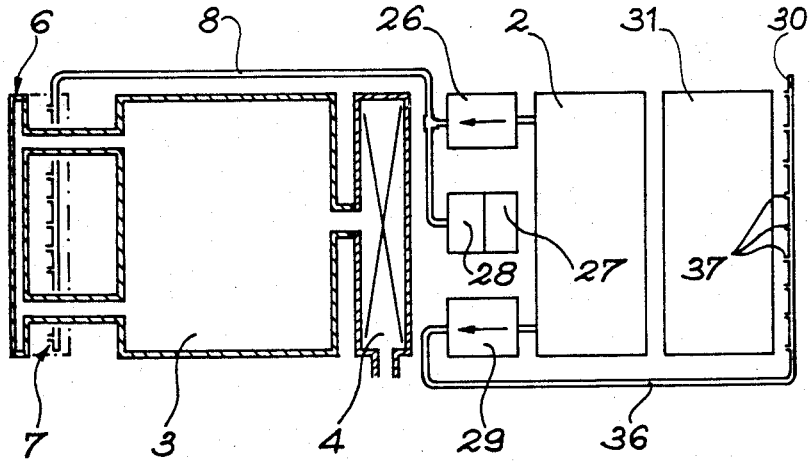

FIG. 4 is a block diagram of the equipment constituting the hydraulic circuit.

FIG. 1 shows a cleaning vehicle according to the invention travelling on a surface to be cleaned, such as a road or a flat concreted area. The vehicle comprises a chassis 1 integral with the wheels and a driving cab 31, together with a clean liquid tank 2. The vehicle supports an assembly constituted by a second tank 3 for containing the sprayed, polluted liquid. Tank 3 which has larger dimensions than the clean liquid tank 2, so that the emptying operations can be as infrequent as possible.

The second tank 3 is linked with a turbine 4, which internally produces a vacuum. By means of suction ramps 5, each constituted by a partly flexible pipe, tank 3 is also linked with a suction device, generally designated by the reference numeral 6. A spraying device 7 is contiguous with the suction device 6 and is positioned to the front of the latter. Device 7 is linked by at least one partly flexible spraying pipe 8 with the clean liquid tank 2. The spraying 7 and suction 6 devices essentially extend in the transverse direction of the vehicle and to the rear thereof.

A system constituted by a jack and a rod 10 makes it possible in turn to engage the suction 6 and spraying 7 devices, which are integral with one another, with the surface to be cleaned and as shown in FIG. 1, or to bring them into an inoperative position, according to which they are located in the vicinity of the rear wall of the second tank 3.

A jack 11 makes it possible to tilt the assembly comprising the second tank 3 about a joint 12 to the rear of the vehicle or truck, which facilitates a rearward emptying of the second tank 3. As the latter is located to the rear of the vehicle, the suction ramps 5 have a reduced length.

With respect to FIG. 2, it can be seen that the suction device 6 more particularly comprises a rear fairing 16, which aids suction. It is made from a rigid material and is completed by a rear sealing strip 18 between its lower edge and the surface to be cleaned and on which strip 18 drags. Fairing 16 can be made from rubber or can be constituted by a brush.

The rear fairing 16 is subdivided into several contiguous parts extending transversely, each of which is connected to a particular suction ramp 5 and which are interconnected by means of longitudinally axed joints, which permit suction under optimum conditions when the surface to be cleaned has an upward or downward curvature.

The joint can be constituted, as shown in FIG. 3, by a flexible strip 33, which connects two contiguous parts of the rear fairing 16, while still permitting angular displacement thereof. Moreover, casters 35 are used for limiting the lowering of the suction 6 and spraying 7 devices.

Each part of the rear fairing 16 is connected to a part of the front fairing 17, which isolates the spraying nozzles 22 from the external medium. Nozzles 22 and the liquid spraying pipes 8 are not directly connected to the front fairing 17, but communicate by ramps 32, which distribute the cleaning liquid of spraying pipes 8 into each of the nozzles 22 located within the same part of the front fairing 17 and which are joined thereto by means of two hinges 23. Thus, ramps 32 can pivot with respect to the front fairing 17, which modifies the orientation of the liquid spraying. Pivoting can be performed manually when the suction 6 and spraying 7 devices are raised from the ground, or automatically by any known means. The cleaning liquid spraying angle relative to the ground can consequently be regulated. (In a similar manner to the rear fairing 16, front fairing 17 can have a front sealing strip 19, which prevents the spraying of cleaning liquid toward the front of the vehicle).

Rear fairing 16 and front fairing 17 are connected, to each of their parts, by a separating partition 20, which separates the suction device 6 from the spraying device 7 and which is extended at its lower edge by a separating strip 21 stopping at a limited distance from the surface to be cleaned. This arrangement ensures that the cleaning liquid is not sucked up before it has reached the surface to be cleaned.

The number of suction ramps 5 and nozzles 22 arranged in the transverse direction of the vehicle is solely dependent on the width of the surface to be cleaned and the dimensions and configuration of the different parts of the device. It is in particular indispensable that the nozzles 22 spray the liquid onto the entire width to be cleaned. In this particular case, there are two suction ramps 5 and twenty nozzles 22.

FIG. 4 defines the overall constitution of the hydraulic circuit. The clean liquid tank 2 contains the water, which a high pressure pump 26 then sprays under pressure towards the spraying device 7. A detergent additive tank 27 is connected to the spraying device 7 via a doser 28, which makes it possible to regulate the composition of the cleaning liquid.

The clean liquid tank 2 is also connected via a low pressure pump 29 and a pipe 36 to a moistening ramp 30 located at the front of the vehicle and close to cab 31. This transverse moistening ramp 30 has moistening nozzles 37 which spray droplets of water onto the surface which will then be cleaned. This moistening operation has the consequence that the polluting particles are temporarily maintained in place and are much less easily dispersed by the turbulence caused by the wheels and air circulation caused by the truck. It is this moistening ramp 30 which justifies the installation of the water spraying and suction devices at the rear of the vehicle. The correct moistening conditions are as follows. The water must be at a relatively low pressure, at atmospheric pressure or in slight overpressure to prevent ricochets with the ground, unlike in the case of the water sprayed to the rear, which is at pressure of 20 bars on leaving nozzles 22. It is sprayed at a low flow rate in order to simply wet that portion of the ground which is under the truck and prevent a lateral flow, as in the case of the cleaning vehicles used under ordinary conditions. Finally, the water must be sprayed substantially vertically, with a possible slight frontward or rearward inclination and with no excessive lateral inclination to the outside, so as not to push the polluting particles out of reach of the rear cleaning device. The moistening nozzles 37 spray continuous water stream at a rate of a few liters per minute.

We claim:

1. A vehicle for cleaning surfaces, comprising: a first tank for storing cleaning liquid;

means for spraying liquid at a first pressure and a first flow rate onto the surface to be cleaned;

means for sucking the sprayed liquid towards a second tank; and means for moistening the surface to be cleaned with liquid at a second pressure and a second flow rate, said second pressure being lower than said first pressure and said second flow rate being lower than said first flow rate, wherein said means for spraying and said means for sucking are located at the rear of the vehicle and said means for moistening the surface are located at the front of the vehicle.

2. The cleaning vehicle according to claim 1, wherein the means for spraying and means for sucking respectively extend substantially along first and second transverse lines of the vehicle.

3. The cleaning vehicle according to claim 2, wherein the means for spraying and means for sucking are isolated from the external medium by fairings terminated by strips which drag on the surface and are impervious to liquids.

4. The cleaning vehicle according to claim 3, wherein the means for spraying and means for sucking are separated by a strip which is impervious to liquids and whose lower edge is at a limited distance from the surface.

5. The vehicle according to claim 1, wherein said means for spraying comprises a high-pressure pump connected to said first tank and said means for moistening comprises a low-pressure pump connected to said first tank.

* * * * *